US006942603B1

(12) United States Patent
Tsai et al.

(10) Patent No.: US 6,942,603 B1
(45) Date of Patent: Sep. 13, 2005

(54) CONTROL SYSTEM OF RESISTING AND ASSISTING FORCE FOR A REHABILITATION APPARATUS

(75) Inventors: Mi-Ching Tsai, Tainan (TW); Tien-Chi Chen, Tainan (TW); Cheng-Hu Chen, Tainan (TW); Jia-Sheng Hu, Tainan (TW); Andy Wu, Tainan Hsien (TW); Joseph Wu, Tainan Hsien (TW)

(73) Assignee: Tonic Fitness Technology, Inc., Tainan Hsien (TW)

( * ) Notice: Subject to any disclaimer, the term of this patent is extended or adjusted under 35 U.S.C. 154(b) by 171 days.

(21) Appl. No.: 10/252,672

(22) Filed: Sep. 24, 2002

(51) Int. Cl.[7] ..... A63B 22/06
(52) U.S. Cl. ..... 482/57; 482/5
(58) Field of Search ..... 482/1–9, 51, 52, 482/57–65, 900

(56) References Cited

U.S. PATENT DOCUMENTS 3,589,193 A * 6/1971 Thornton ..... 482/2
3,848,467 A * 11/1974 Flavell ..... 482/4
3,869,121 A * 3/1975 Flavell ..... 482/2
5,919,115 A * 7/1999 Horowitz et al. ..... 482/6
2001/0019985 A1 * 9/2001 Reck

* cited by examiner

*Primary Examiner*—Justine R. Yu
*Assistant Examiner*—Tam Nguyen
(74) *Attorney, Agent, or Firm*—Bacon & Thomas, PLLC

(57) ABSTRACT

A control system of resisting and assisting force for a rehabilitation apparatus includes a motor, a resistance adjustment control device and a motor output force control device. The motor drives the rotating wheels of the rehabilitation apparatus and controls the rotating wheels to produce resistance and power assisting force. The resistance is designed by imitating the frictional force of different road conditions. The motor output force control device gathers the resistance value preset by the resistance adjustment control device. and the force of a patient pushing or pedaling the rotating wheels and then controls the compensation and the output force of the motor to push the rotating wheels. When the resistance is adjusted to become increasingly larger and larger by the resistance adjustment device, the force of a patient's hands or legs will gradually increase and finally able to push or pedal the rotating wheels by himself.

4 Claims, 5 Drawing Sheets

CONTROL SYSTEM OF RESISTING AND ASSISTING FORCE FOR A REHABILITATION APPARATUS

BACKGROUND OF THE INVENTION

This invention relates to a control system of resisting and assisting force for a rehabilitation apparatus, particularly to one used to design a multi-stage rehabilitation program by imitating the frictional resistance of different road conditions to carry out rehabilitation of a patient's hands or legs in proper sequence. In the process of rehabilitation, the power assisting force of a motor for the rotating wheel of a wheelchair and for the pedal of a stationary bike will gradually decrease and finally the patient will be able to push the wheelchair and pedal the stationary bike by himself, achieving effect of rehabilitation of a patient's hands or legs.

Conventional wheelchairs are divided into two categories: hand-pushing wheelchair and power-driving wheelchair. The hand-pushing wheelchair is not supplied with any power, therefore in case a patient has his hand hurt (such as convulsion, scald or sport hurt), he cannot push the wheelchair to move by himself without other people's help. The power-driving wheelchair is provided with a motor to supply power so a patient seated therein needs only to control a swing rod to make the wheelchair move back and forth and change directions, needing no labor in moving it about.

Further, a conventional stationary bike is provided with a generator to produce resistance and applies various braking skills to offer feeling of the resistance, able to acquire different perception of brake and resistance through power control. However, such a conventional stationary bike cannot supply power-assisting force, nor can it imitate various frictional forces of different road conditions.

In fact, the two kinds of conventional wheelchairs mentioned above are not helpful nor effective for the recovery of a patient's hands, while the foresaid conventional stationary bike has no function of imitating different road conditions. In view of these problems, this invention is devised to improve the defects and maintain the functions of the conventional wheelchair and the stationary bike.

SUMMARY OF THE INVENTION

This invention is devised to offer a control system of resisting and assisting force for a rehabilitation apparatus, able to imitate various frictional resistances of different road conditions to help a patient to carry out gradual rehabilitation of his hands or legs through a multi-stage rehabilitation program. In the process of rehabilitation, power-assisting force offered by a motor will gradually decrease in order to enable the patient to push the wheelchair or pedal the stationary bike by himself.

The control system of resisting and assisting force for a rehabilitation apparatus includes a motor able to offer power assisting force to the rotating wheels of a wheelchair and a stationary bike for helping to move the rotating wheels; the system also has a resistance adjustment control device able to program and control the resistance produced by the rotating wheels, with the degree of the resistance designed by imitating the frictional force of different road conditions and the friction coefficient of the resistance arranged from small to large; a motor output force control device controlling the compensation and the output force of the motor through physical property analysis of a standard motor after it gathers together the resistance value set by the resistance adjustment control device and the push force produced by a patient pushing or pedaling the rotating wheels when the rotating wheels depart from the ground.

Thus, when the rotating wheels of the rehabilitation apparatus depart from the ground and a patient tries to apply strength to push or pedal the rotating wheels of preset resistance, the motor output force control device will automatically detect the force of the preset resistance and the pushing and pedaling strength, and then control the motor to supply adequate power assisting force for helping to push the rotating wheels. When the resistance is adjusted to become increasingly larger and larger by the resistance adjustment control device, the strength of patient's hands or legs will gradually increase and finally the patient will be able to push or pedal the rotating wheels alone without help of power assisting force, attaining effect of rehabilitation of hands and legs in proper sequence.

BRIEF DESCRIPTION OF DRAWINGS

This invention will be better understood by referring to the accompanying drawing, wherein.

DETAILED DESCRIPTION OF THE PREFERRED EMBODIMENT

Figure 1:
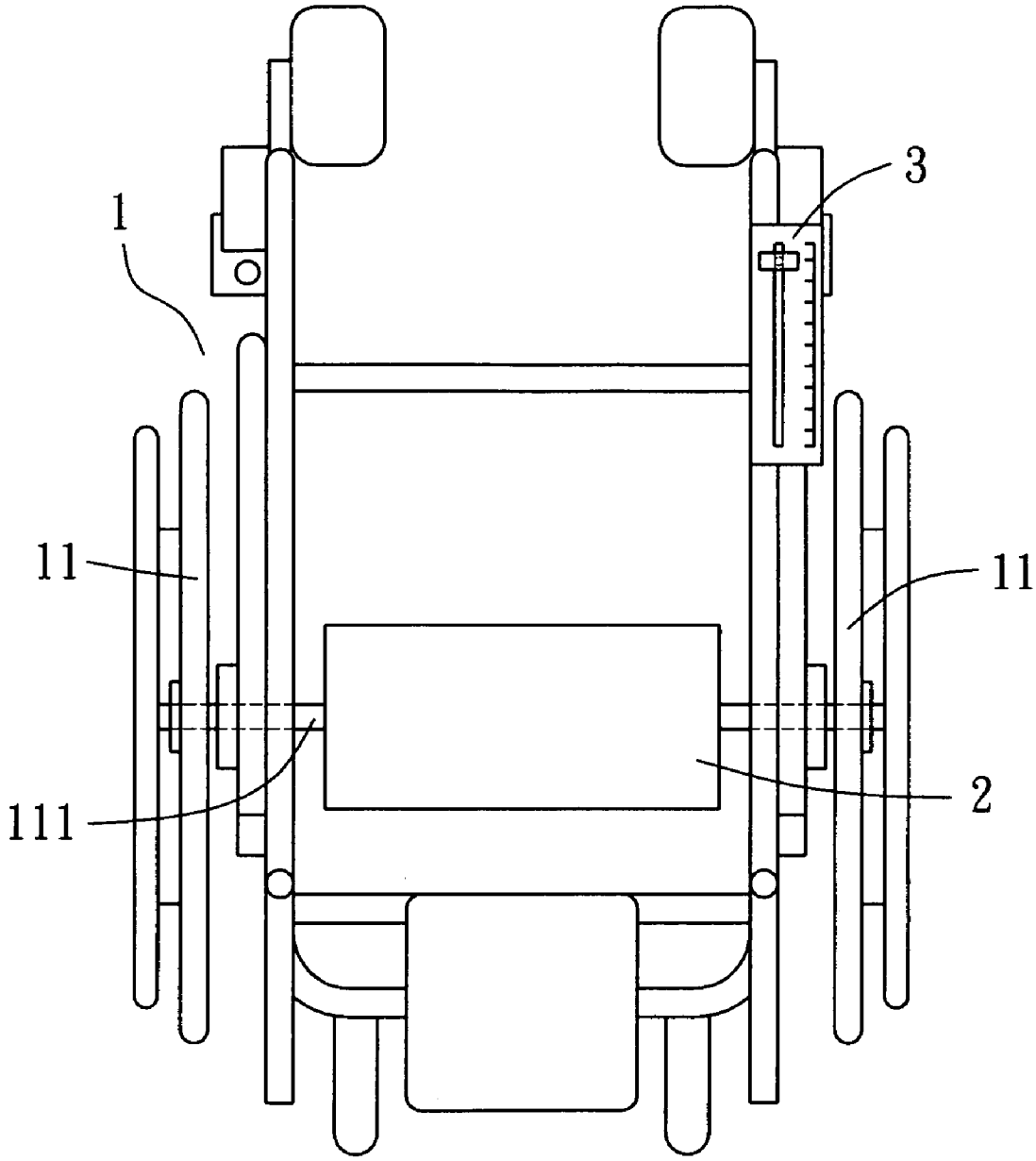
FIG. 1 is an upper view of a first embodiment a c control system of resisting and assisting force applied to a rehabilitation wheelchair in the present invention.

A first embodiment of a control system of resisting and assisting force in the present invention is applied to a rehabilitation wheelchair, as shown in FIG. 1, including a motor 2, a resistance adjustment control device 3 and a motor output force control device 4.

The rehabilitation wheelchair 1 has function of hand rehabilitation, having the shaft 111 of its rotating wheels 11 driven by the motor 2.

The resistance adjustment control device 3 controls the rotating wheels 11 to produce resistance, whose force can be adjusted and set up by imitating the frictional force of different road conditions, with the friction coefficient of the resistance arranged from small to large. Besides, the resistance adjustment control device 3 can be designed as shifting gears or a revolving button, provided at a location near the armrest of the wheelchair 1 for facilitating operation.

Figure 2:
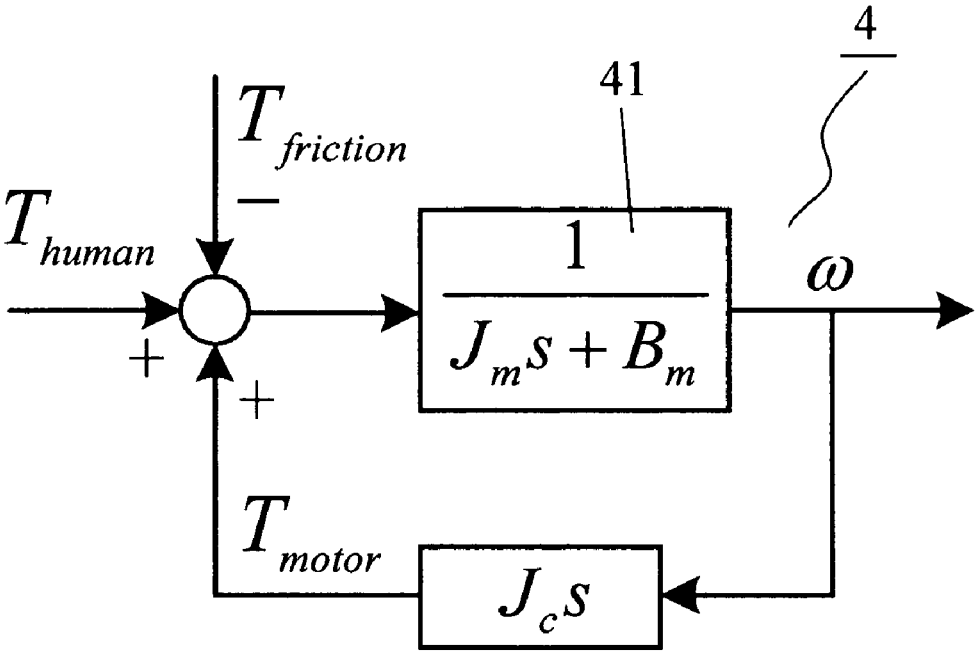
FIG. 2 is a block diagram of a control principle applied in FIG. 1.

The motor output force control device 4, as shown in FIG. 2, controls the compensation and the output force of the motor 2 through physical property analysis 41 of standard motor after it gathers the resistance value of the resistance adjustment control device 3 and the push force of a patient pushing the rotating wheel 11 with hands during the rotating wheel 11 departing from the ground.

Thus, when a patient is to carry out hand rehabilitation, the wheelchair 1 is hoisted to let its rotating wheels 11 depart from the ground, and the resistance adjustment control device 3 is operated to adjust the resistance offered by the motor 2 to the rotating wheels 11 to the lowermost stage (i.e. smallest resistance) and then have the patient hands respectively hold the rotating wheels 11 of preset resistance. When the patient begins to apply strength to try to push the rotating wheels 11, the strength of his hands is always smaller than the resistance of the rotating wheels 11 so the rotating wheels 11 can hardly be pushed forward. At this moment, the motor output force control device 4 will automatically detect the resistance value preset by the resistance adjustment control device 3 and the strength of a patient's hands pushing the rotating wheels 11 and then calculate how much compensatory power assisting force that the motor 2 needs to output to the rotating wheels 11 after physical property analysis 41 of standard motor, as shown in FIG. 2. The calculating formula of the power assisting force is as follows.

$$T_{motor}=J_c a$$

$$T_{human}+T_{motor}-T_{friction}=J_m a+B_m\omega$$

$$(T_{human}-T_{friction})=(J_c+J_m)a+(B_m)\omega$$

In the formula, $T_{motor}$ is the power assisting force, $T_{human}$ the pushing force of a patient, $T_{friction}$ the friction force to be simulated, $J_m$ inertia of the motor, $B_m$ adhesive friction coefficient of the motor, $\alpha$ angle speed, $J_c$ a simulated inertia given by the controller, $B_c$ adhesive friction coefficient given by the controller, and $\omega$ angle speed.

Based on the control principle shown in FIG. 2 and the above-mentioned calculating formula, the motor output force control device 4 is able to calculate and then control the motor 2 to supply adequate power assisting force, which, in cooperation with the push force of the patient's hands, will overcome the frictional resistance of the rotating wheels 11 and push the rotating wheels 11 to rotate smoothly. Then, when the strength of the patient's hands somewhat recovers, the power assisting force supplied by the motor 2 will decrease by degrees and finally the patient will be able to push the rotating wheels 11 by himself without help of the power assisting force of the motor 2. At this moment, the resistance adjustment control device 3 will proceed to the next rehabilitation stage with relatively large resistance. In case the strength of the patient's hands increases after repeated rehabilitation, the resistance adjustment control device 3 will have its resistance stage heightened by degrees (i.e. gradually enlarging the frictional resistance of the rotating wheels 11).

Thus, after the frictional resistance of the rotating wheels 11 is increasingly heightened and the patient's hands are gradually strengthened, the patient will finally be able to push the wheelchair 1 to move by himself without help of the power assisting force of the motor 2, achieving effect of rehabilitation of a patient's hands step by step.

Figure 3:
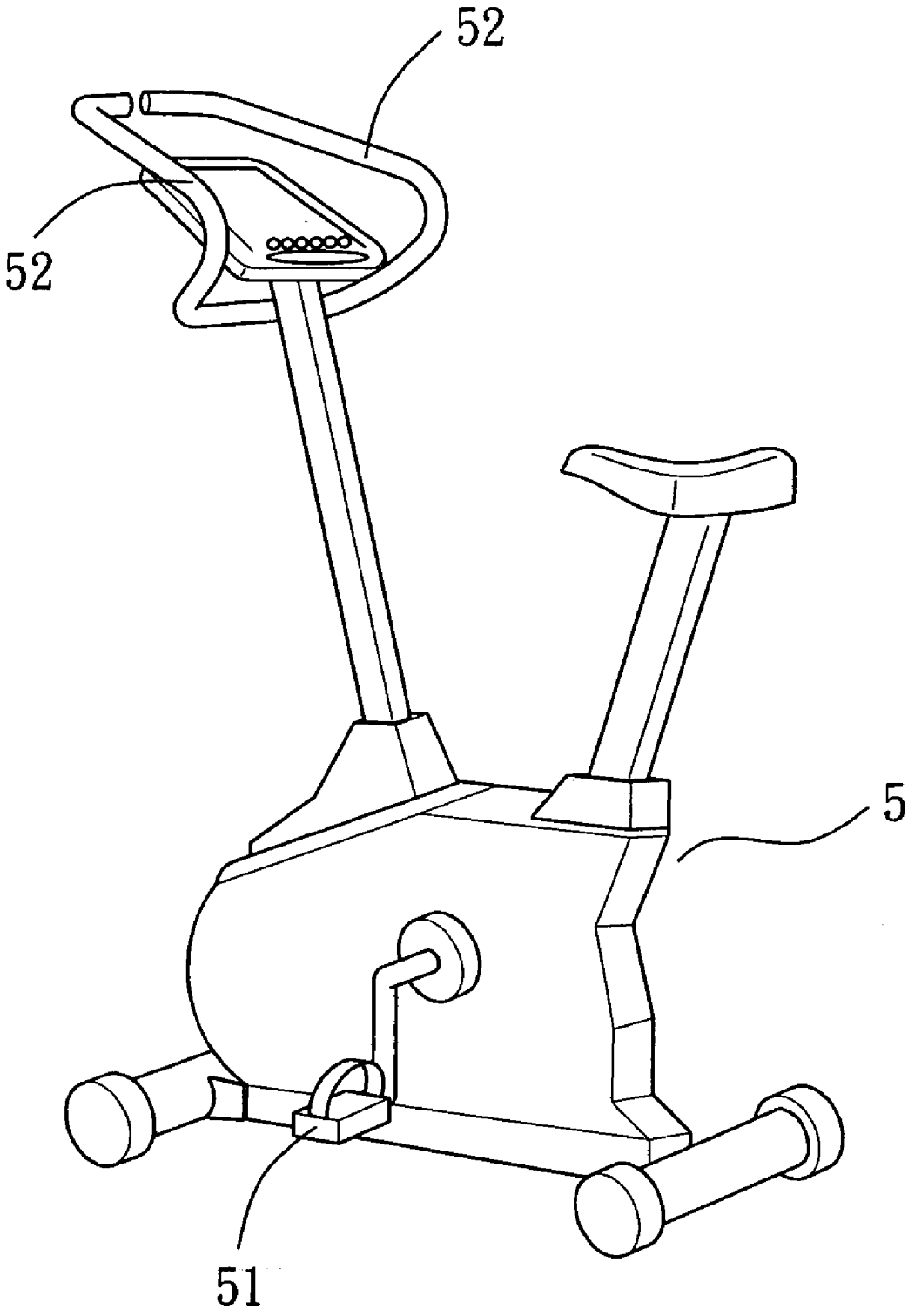
FIG. 3 is a perspective view of a second embodiment of a control system of resisting and assisting force applied to a stationary bike in the present invention.

A second preferred embodiment of a control system of resisting and assisting force in the present invention is applied to a stationary bike 5, as shown in FIG. 3, including a motor 2, a resistance adjustment control device 3 and a motor output force control device 6.

The motor 2 (not shown) is installed inside the stationary bike 5 for driving the pedals 51 of the stationary bike 5.

The resistance adjustment control device 3 supplies resistance to the pedals 51 of the stationary bike 5, and the degree of the resistance is designed by imitating the frictional force of different road conditions, with the friction coefficient of the resistance arranged from small to large. Further, the resistance adjustment control device 3 is disposed near the armrests 52 of the stationary bike 5 for facilitating handling.

Figure 4:
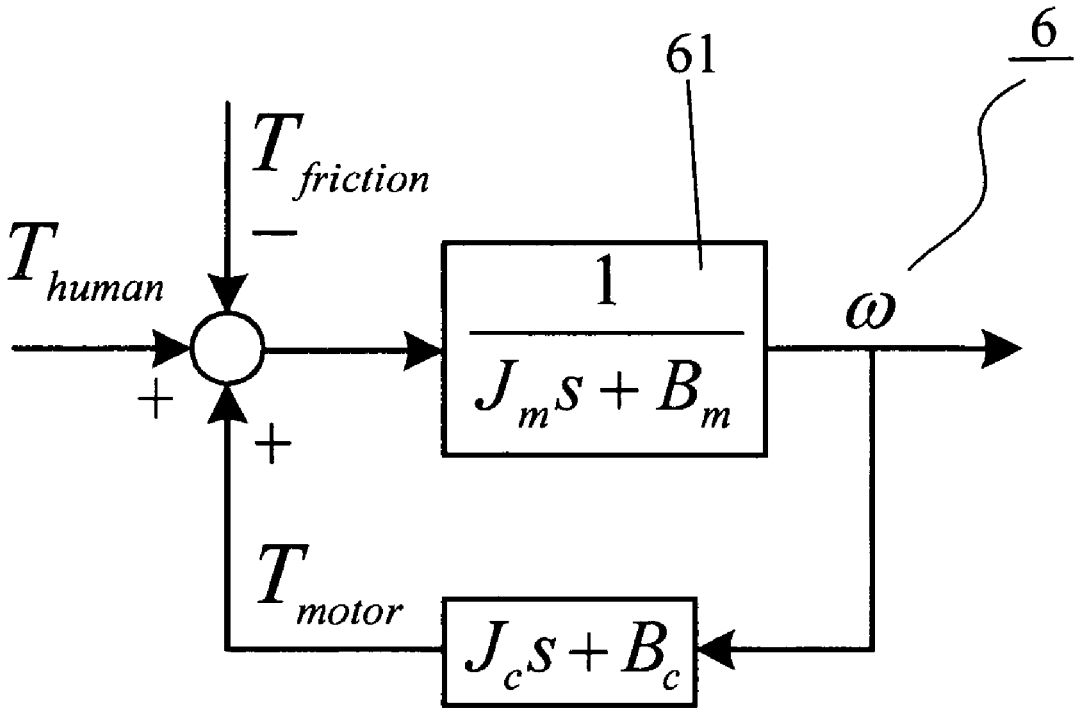
FIG. 4 is a block diagram of the control principle applied in FIG. 3.
Figure 5:
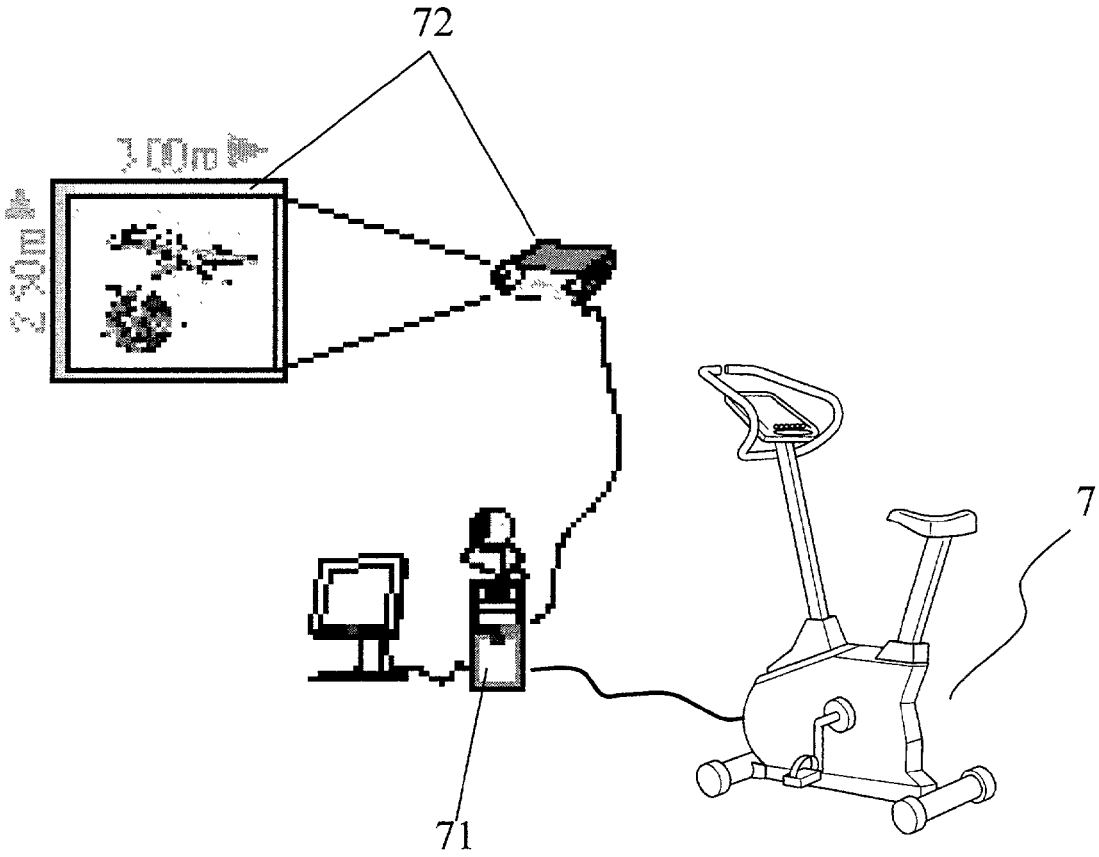
FIG. 5 is a perspective view of a third embodiment of a control system of resisting and assisting force applied to a virtual simulating stationary bike in the present invention.

The motor output force control device 6, as shown in FIG. 4, controls the compensation and the output force of the motor 2 through physical property analysis 61 of a standard motor after it gathers together the resistance value of the resistance adjustment control device 3 and the pedaling force of a patient. The calculating formula of the power assisting force of the motor in the second embodiment is shown as follows.

$$T_{motor}=J_c a+B_c\omega$$

$$T_{human}+T_{motor}-T_{friction}=J_m a+B_m\omega$$

$$(T_{human}-T_{friction})=(J_c+J_m)a+(B_m+B_c)\omega$$

Before carrying out leg rehabilitation by the stationary bike 5, firstly adjust the set value of the resistance adjustment control device 3 to the lowermost stage and then carry out leg rehabilitation according to the mode and the process described in the first preferred embodiment.

A third preferred embodiment of a control system of resisting and assisting force in the present invention is applied to a virtual simulating stationary bike 7 able to be connected with network, a video-signal inter-talk device 71 and an amusement video projection device 72. The control principle and analysis used by the virtual simulating stationary bike 7 is the same as those illustrated in FIG. 4 in order to realize force feedback resistance of the virtual scenes stationary bike 7 when the control method in this invention is employed to accomplish interaction with virtual simulation, and realize resistance control of the virtual simulating stationary bike 7 by the motor 2. As can be noted from the above description, the method of producing and controlling resistance in this invention is quite different from that of the conventional stationary bike which employs a generator to produce resistance and controls the resistance by braking.

While the preferred embodiment of the invention has been described above, it will be recognized and understood that various modifications may be made therein and the appended claims are intended to cover all such modifications that may fall within the spirit and scope of the invention.

What is claimed is:

1. A control system of resisting and assisting force for a rehabilitation apparatus comprising:

a motor driving a shaft of rotating wheels of said rehabilitation apparatus to rotate, said rotating wheels are able to be pushed by hands or pedaled by feet of a user said motor able to supply said rotating wheels with a power assisting force of different degrees for pushing said rotating wheels;

a resistance adjustment control device able to offer a resistance to said rotating wheels, a degree of said resistance designed by imitating frictional force of different road conditions, a friction coefficient of said resistance being arranged from small to large;

a push force detecting device for detecting a push force produced by a user pushing manually or pedaling said rotating wheels when said rotating wheels depart from ground; and a motor output force control device connected to said resistance adjustment control device and said push force detecting device for gathering a resistance value preset by said resistance adjustment control device and said push force produced by a patient pushing manually or pedaling said rotating wheels when said rotating wheels depart from the ground, said motor output force control device controlling compensation of said motor based on a physical property analysis of a standard motor, said motor output force control device then controlling an output force of said motor to supply said power assisting force for pushing said rotating wheels;

said rotating wheels of said rehabilitation apparatus departing from the ground, a user having his hands or feet push or pedal said rotating wheels of preset resistance, said motor output force control device automatically detecting a resisting force of said rotating wheels and said pushing or pedaling force when said rotating wheels of said rehabilitation apparatus depart from the ground and a user has his/her hands or feet push or pedal said rotating wheels of a preset resistance, said motor output force control device controlling said motor to supply adequate said power assisting force for pushing said rotating wheels, said resistance adjusted to become increasingly larger and larger by said resistance adjustment control device, the user finally able to push or pedal said rotating wheels by himself without help of said power assisting force with the force of the user's hands or legs increased by degrees, achieving effect of gradual rehabilitation of the hands or legs.

2. The control system of resisting and assisting force for a rehabilitation apparatus as claimed in claim 1, wherein said rehabilitation apparatus is a hand-pushing wheelchair.

3. The control system of resisting and assisting force for a rehabilitation apparatus as claimed in claim 1, wherein said rehabilitation apparatus is a pedaling stationary bike.

4. The control system of resisting and assisting force for a rehabilitation apparatus as claimed in claim 3, wherein said stationary bike is a virtual simulating stationary bike able to be connected with a network or combined with a virtual simulation.

* * * * *